US007296367B2

(12) United States Patent
Kipnes

(10) Patent No.: US 7,296,367 B2
(45) Date of Patent: Nov. 20, 2007

(54) PEDICURE BOOT

(75) Inventor: Deanna H. Kipnes, Marlboro, NJ (US)

(73) Assignee: Tres Chicas LLC, Marlboro, NJ (US)

( * ) Notice: Subject to any disclaimer, the term of this patent is extended or adjusted under 35 U.S.C. 154(b) by 89 days.

(21) Appl. No.: 11/105,888

(22) Filed: Apr. 14, 2005

(65) Prior Publication Data

US 2006/0230637 A1 Oct. 19, 2006

(51) Int. Cl.
*A43B 7/26* (2006.01)

(52) U.S. Cl. ..... 36/94; 36/101

(58) Field of Classification Search ..... 36/101, 36/94

See application file for complete search history.

(56) References Cited

U.S. PATENT DOCUMENTS 1,349,095 A * 8/1920 Parisi ..... 36/94
2,200,080 A 5/1940 Fein
2,236,367 A 3/1941 Gruber
2,302,596 A 11/1942 Bigio
2,444,640 A * 7/1948 Epstein ..... 36/101
2,506,308 A 5/1950 Maynier
2,507,120 A * 5/1950 Shapiro ..... 36/11.5
2,740,207 A 4/1956 Starensier
2,751,693 A 6/1956 Baker
2,831,272 A 4/1958 Sloat
4,177,583 A 12/1979 Chapman
5,280,679 A 1/1994 Edelman
5,483,757 A * 1/1996 Frykberg ..... 36/101
5,778,565 A 7/1998 Holt et al.
5,926,978 A 7/1999 Smith
5,946,823 A * 9/1999 Yates ..... 36/11.5
6,272,771 B1 8/2001 Rodi
6,415,448 B1 7/2002 Glogover
6,678,971 B2 1/2004 Brooks
2003/0145492 A1* 8/2003 Brooks ..... 36/94
2006/0064902 A1 3/2006 Ashton

* cited by examiner

*Primary Examiner*—Ted Kavanaugh
(74) *Attorney, Agent, or Firm*—Watov & Kipnes, P.C

(57) ABSTRACT

The present invention is directed to a pedicure boot having a forward end of an upper member detachably secured to the forward end of the sole member to enable the toes of the user to be exposed and then covered as needed without having the forward end of the upper member detached from the pedicure boot.

7 Claims, 9 Drawing Sheets

PEDICURE BOOT

FIELD OF THE INVENTION

The present invention is generally directed to a pedicure boot which can be worn as a protective boot, particularly in cold or inclement weather upon arrival and while leaving a pedicure salon. When the pedicure is provided, the forward end of the pedicure boot may be adjusted to temporarily expose the toes so that the pedicure operator may provide a pedicure and then repositioned to protect the toes when the user leaves the salon, especially in cold or inclement weather.

BACKGROUND OF THE INVENTION

Pedicure salons are well known and are frequented predominantly by women. In warm weather, it is commonplace for the procurer of a pedicure to arrive at the pedicure salon in open toe sandals which can be easily removed or remain on the user during the pedicure. When the pedicure is completed, there is often a period of time, typically up to one hour in which the polish applied to the toes must have ample time to dry.

Accordingly, it is commonplace for the procurer of a pedicure to arrive at a pedicure salon in open toe sandals. The sandals may be removed during the pedicure and then placed again on the feet after the pedicure is completed without adversely affecting the nail polish applied to the toes. The user can then wear the open toe sandals when leaving the pedicure salon even if the nail polish is not completely dry because the toes and particularly the nail polish applied thereto do not come into contact with any portion of the open toe sandals. This system works well in warm temperatures and under good weather conditions.

However, when the outside temperature decreases (e.g. from early to mid-Fall through early-Spring and particularly during the Winter) or during inclement weather such as rain or snow the use of an open toe sandal especially after leaving a pedicure salon is problematical. Once the pedicure is completed, the user must remain in the pedicure salon until the nail polish is completely dry which can take up to an hour. Because the open toe sandal provides no protection against cold or inclement weather, any attempt to leave the pedicure salon with an open toe sandal can result in significant discomfort to the user and can adversely affect the pedicure itself. Exposure to cold becomes very uncomfortable for the user and may even expose the user to a chill resulting in sickness because of the complete exposure of the lower portion of the foot that takes place when wearing open toe sandals.

Examples of pedicure sandals are shown in U.S. Pat. Nos. 2,751,693; 5,946,823; and 6,678,971. Each of these pedicure sandals show significant exposure of the foot in order to allow the polished toes ample opportunity to dry. In each case, not only are the toes exposed, but a substantial part of the foot and upper ankle are exposed to the elements as well.

U.S. Pat. No. 5,946,823 shows a pedicure sandal system in which the toes are protected by a removable cover assembly that can slip over the forward end of the sandal and is completely removable therefrom. A problem with pedicure sandal systems of this type is that the cover assembly must be completely removed to expose the toes and therefore forms an entirely separate unit from the sandal itself. Thus, there is always the possibility of losing or misplacing the toe cover assembly rendering the sandal useless for protecting the toes.

It would be a significant advance in the art of pedicure systems to provide a pedicure boot which minimizes exposure of the toes after completion of the pedicure and provides protection to the user, particularly when having to leave pedicure salons in cold or inclement weather.

It would be a further advance in the art of pedicure systems to provide a pedicure boot in which exposure of the toes can be occasioned by adjusting the forward end of the boot in a manner which does not cause complete detachment of the forward end such as described in U.S. Pat. No. 5,946,823.

SUMMARY OF THE INVENTION

The present invention is generally directed to a pedicure boot which employs a sole member preferably a resilient sole member operatively engaged to an upper member and when so engaged forms a foot receiving space. The boot has a forward end which can be adjusted from a position exposing the toes to another position in which the toes are not exposed without having any portion of the boot totally detached therefrom.

In a particular aspect of the present invention, there is provided a pedicure boot comprising:

a) a sole member having a forward end;

b) an upper member operatively engaged to the sole member to form a foot receiving space, said upper member having a forward end releasably engageable to the forward end of the sole member while a remaining portion of the upper member remains engaged to the sole member, said forward end of the upper member being movable from a first position in engagement with the forward end of the sole member to a second position disengaged from the forward end of the sole member to thereby expose a toe portion of a user's foot; and c) first attachment means for releasably engaging the forward end of the upper member to the forward end of the sole member in said first position.

In another embodiment of the invention there is also provided an engagement means for engaging the forward end of the upper member to another position on the upper member while the upper member is in the second position disengaged from the sole member.

In another aspect of the invention, the pedicure boot has a rear portion with an opening for receiving the foot, the rear portion comprising a second attachment means for reversibly separating the rear portion into separated components to facilitate entry of the foot into the pedicure boot.

In a further aspect of the invention, the upper member disengages from the sole member not only at the front end of the boot but along one side thereof thus combining the functions of selectively exposing the toes and facilitating placement of the user's foot in the boot.

In this particular aspect of the present invention, there is provided a pedicure boot comprising:

a) a sole member having a forward end and a side portion;

b) an upper member operatively engaged to the sole member to form a foot receiving space, said upper member having a forward end and a side portion releasably engageable to the forward end and side portion of the sole member while a remaining portion of the upper member remains engaged to the sole member, said forward end of the upper member being movable from a first position in engagement with the forward end of the sole member to a second position disengaged from the forward end of the sole member to thereby expose a toe portion of the user's foot; and c) first attachment means for releasably engaging the forward end and the side portion of the upper member to the forward end and side portion of the sole member in said first position.

BRIEF DESCRIPTION OF THE DRAWINGS

The following drawings in which like reference characters indicate like parts are illustrative of embodiments of the invention and are not intended to limit the invention as encompassed by the claims forming part of the application.

DETAILED DESCRIPTION OF THE INVENTION

The present invention is generally directed to a pedicure boot which provides full protection of a boot while enabling the front portion of the boot to be moved to a position exposing the toes to enable the application of a pedicure and particularly nail polish and then to provide protection for the user when leaving a pedicure salon much greater than that afforded by open toe pedicure sandals.

Figure 1:
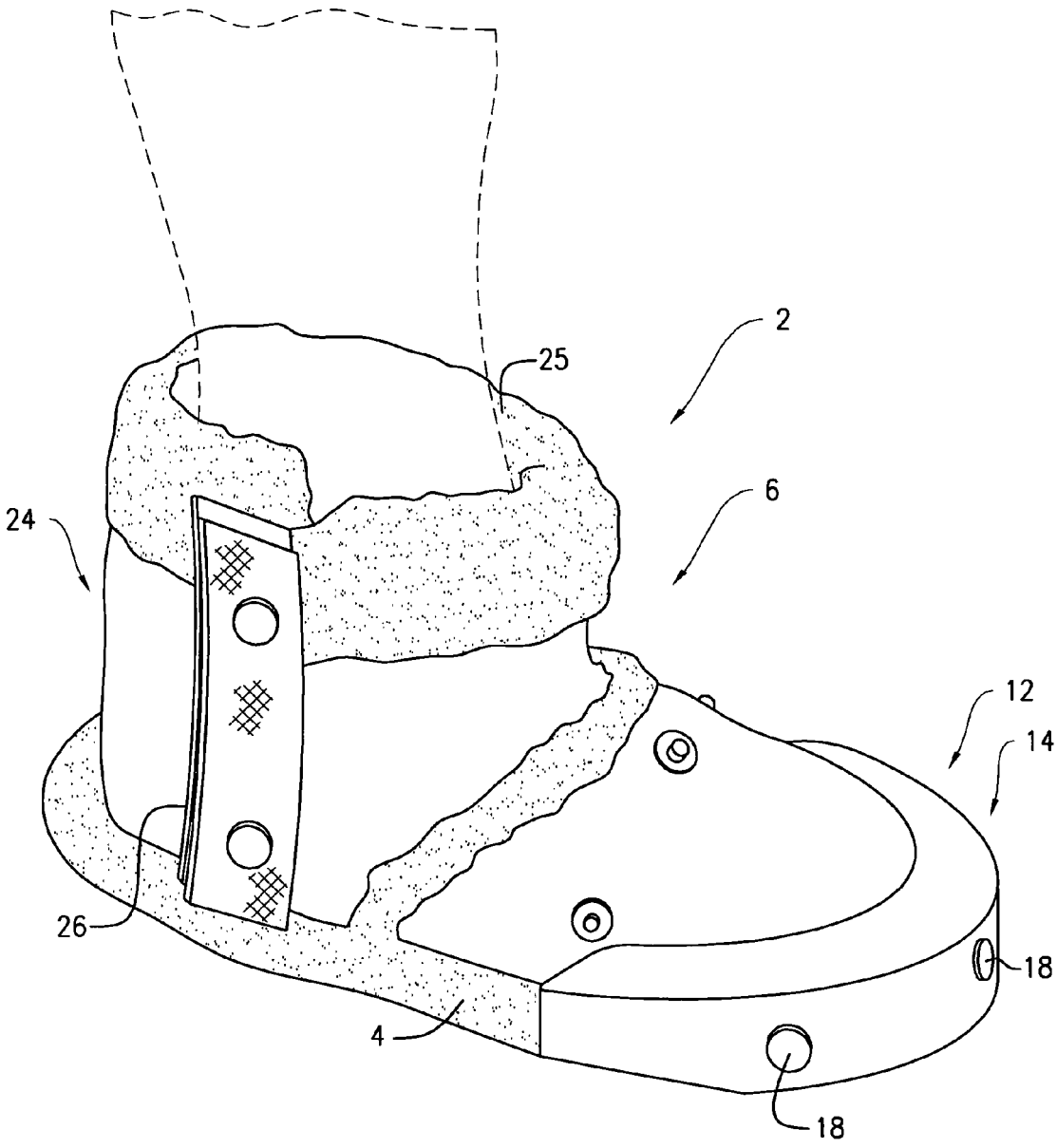
FIG. 1 is a side elevational view of an embodiment of the pedicure boot of the present invention.
Figure 2A:
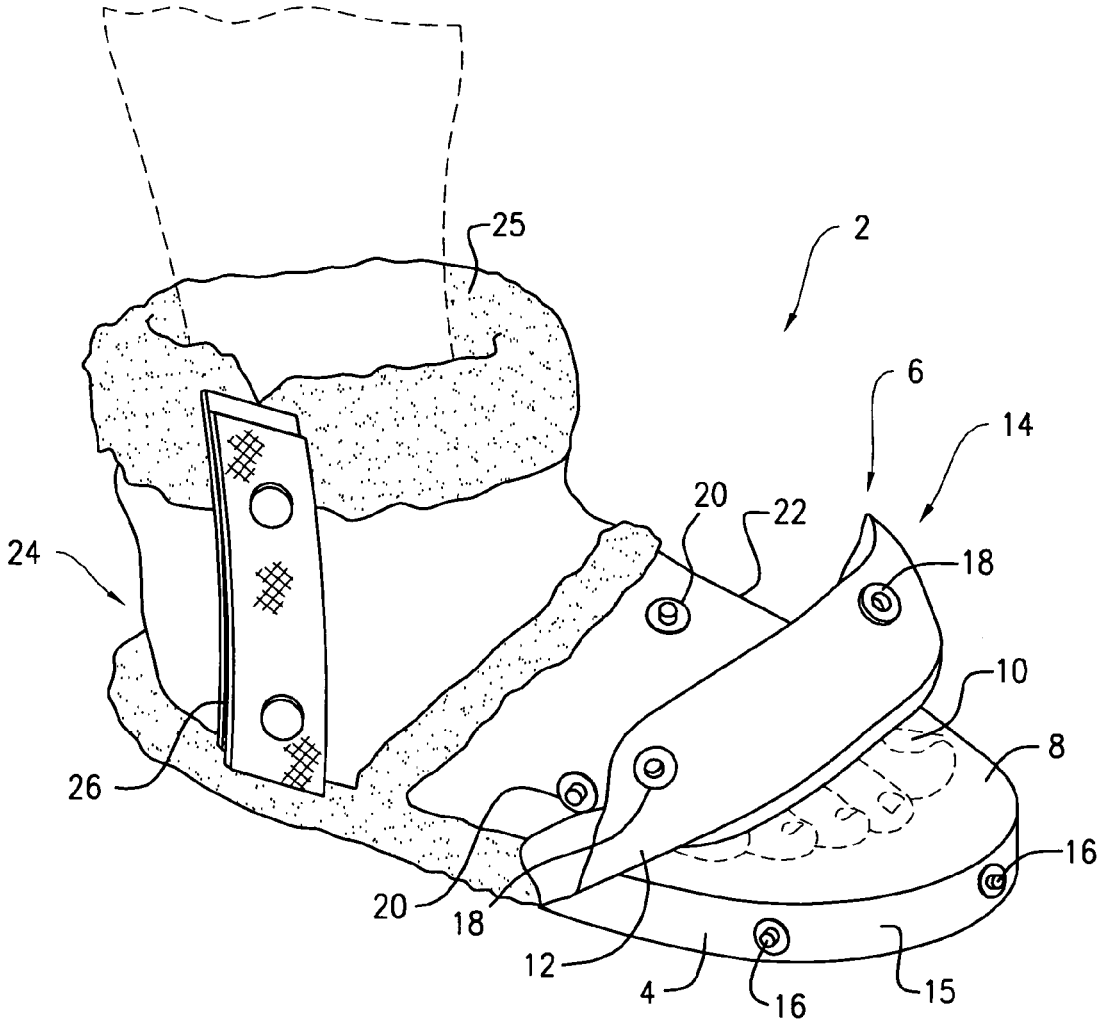
FIG. 2*a* is a perspective view of the embodiment of the invention shown in FIG. 1 with the forward end of the upper member disengaged from the sole member to expose the toes.
Figure 2B:
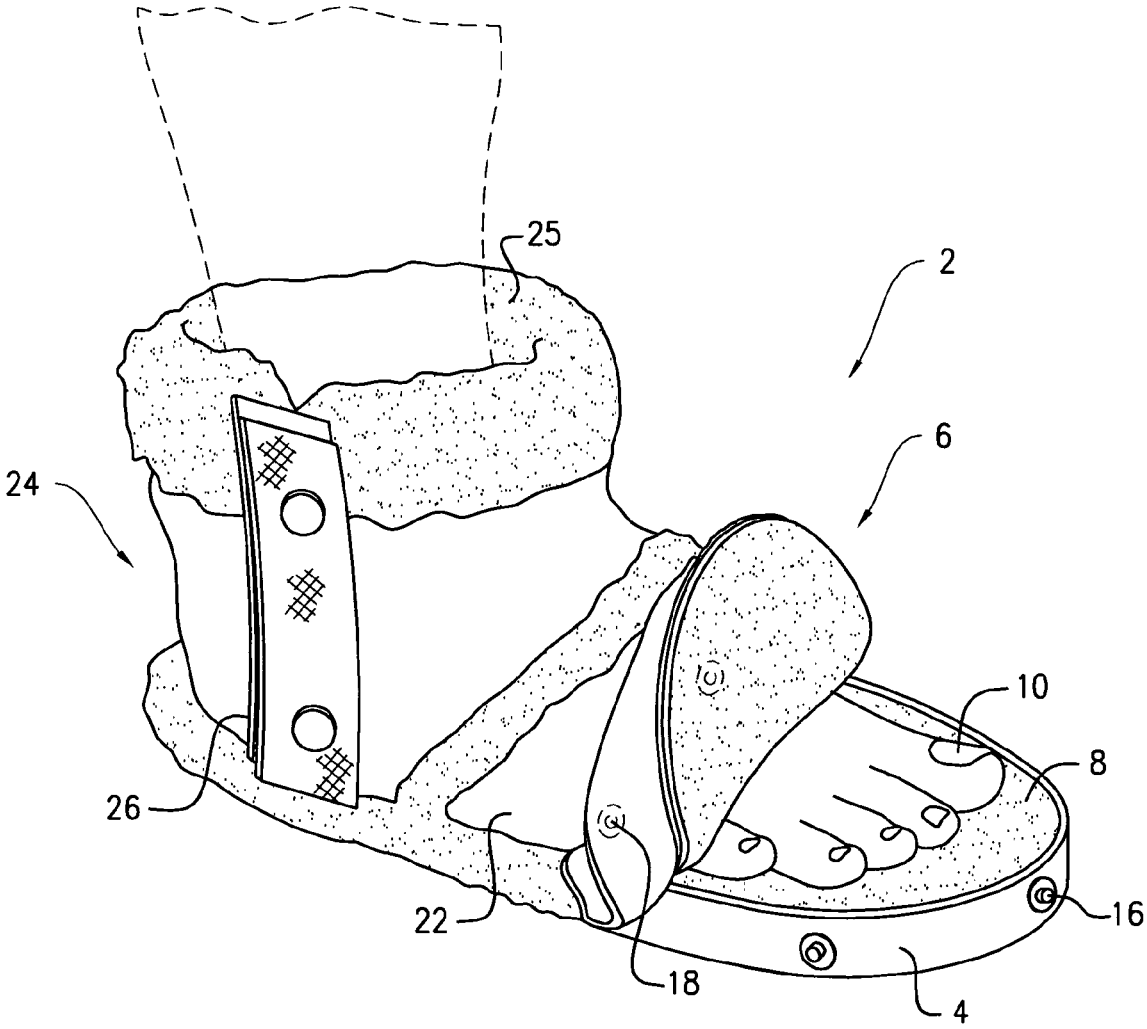
FIG. 2*b* is a perspective view similar to FIG. 2*a* in which the forward of the upper member is secured in place to expose the toes.
Figure 3:
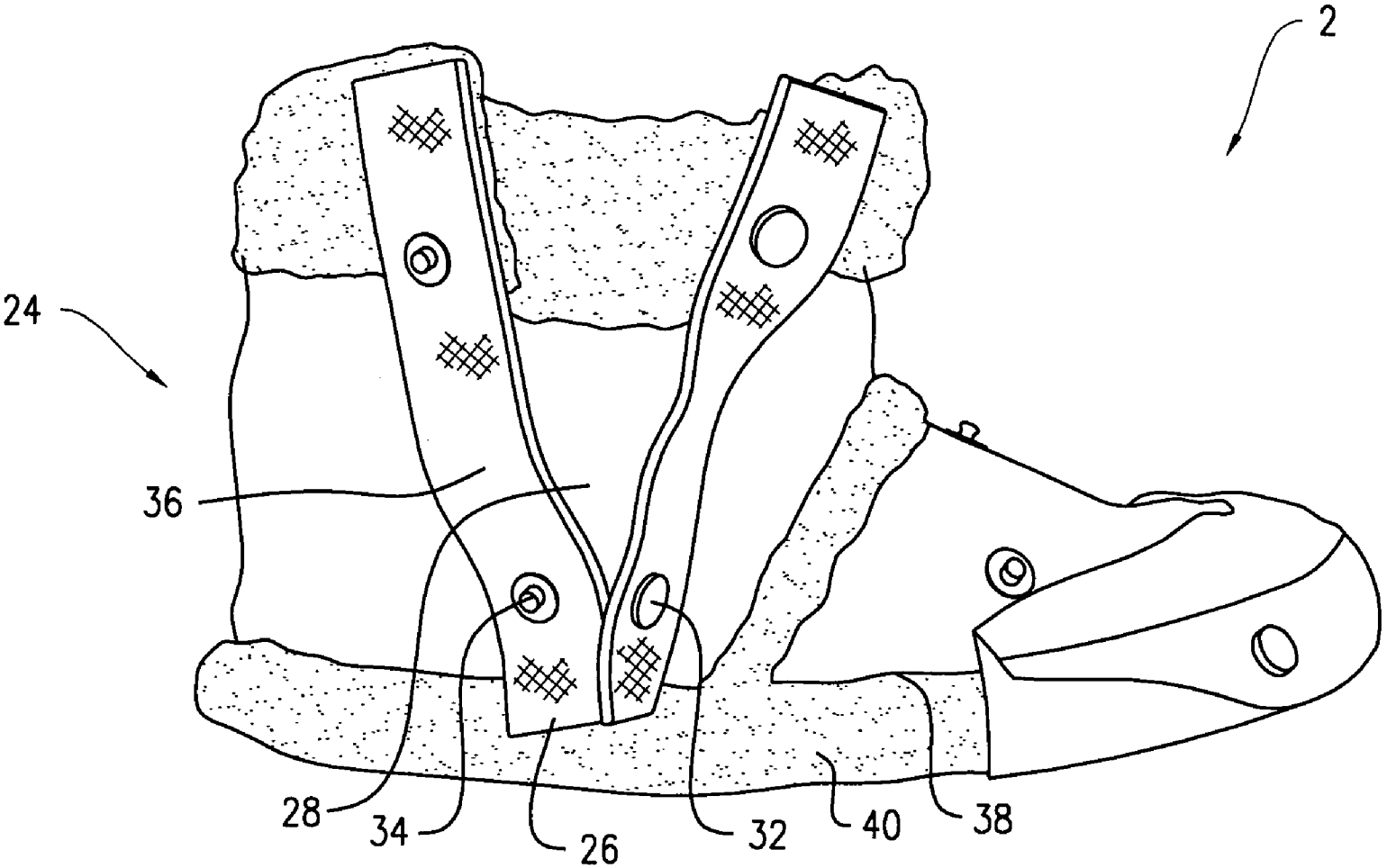
FIG. 3 is a side elevational view of the embodiment of FIG. 1 showing a second portion of the upper member in a position to allow easy access of the user's foot into the pedicure boot.

Referring to the drawings and particularly to FIGS. 1-3, there is shown an embodiment of a pedicure boot 2 in accordance with the present invention in which the forward ends of the sole member and an upper member are engageable to expose and then protect the toes during and after a pedicure. The pedicure boot 2 is comprised of a sole member 4 and an upper member 6. As shown for example in FIGS. 2*a* and 2*b*, the sole member 4 forms with the upper member 6, a foot receiving surface 8 therebetween for receiving the foot of the user and particularly the toes identified by reference numeral 10.

The upper member 6 has a forward end 12 which provides a protective cover for the front portion of the foot of the user and particularly the toes. There is provided at the forward end 12 a first attachment assembly 14 which secures the forward end 12 of the upper member 6 to the forward end 15 of the sole member 4 (see FIG. 2*a*) as discussed below.

The first attachment assembly 14 can be any attachment device that can provide removable attachment of the forward end 12 of the upper member 6 to the forward end 15 of the sole member 4. Preferred examples of the first attachment assembly 14 are hook and eye assemblies (e.g. Velcro®) and male and female snap members.

In the embodiment shown specifically in FIGS. 1-3, the first attachment assembly 14 comprises male and female snap members 16 and 18, respectively. The male snap members 16 (see FIG. 2*a*) are attached to the forward end 15 of the sole member 4 and are engageable to corresponding female snap members 18 appearing on the underside of the forward end 12 of the upper member 6. Engagement of the male snap member 16 to the female snap member 18 places the forward end 12 of the upper member 6 in a toe covering or first position as shown in FIG. 1 wherein the toes are covered by the front end of the pedicure boot.

Disengagement of the female snap member 18 from the male snap member 16 enables the forward end 12 to be lifted to a second position exposing the toes 10 as best shown in FIGS. 2*a* and 2*b*. The forward end 12 may be secured in the second or toe exposing position shown in FIG. 2*b* by engagement of a first engaging device in the form of the female snap members 18 with a second engaging device in the form of male snap members 20 appearing on a rearward portion 22 of the forward end 12 of the upper member 6. Thus, the forward end 12 forms a flap movable from the first position shown in FIG. 1 covering the toes to a position shown in FIGS. 2*a* and 2*b* exposing the toes while the pedicure boot remains on the user's foot.

It will be understood that the first attachment assembly 14, exemplified using engageable snap members (16, 18 and 20) can readily be replaced by other attachment assemblies enabling removable attachment as described above including Velcro® and the like. It will be further understood that the position of the male and female snap members can be reversed (i.e. the male snap member can be placed on the underside of the forward end 12 and the female snap member can be placed on the forward end of the sole member). In addition, the particular method of attachment employed for the first attachment assembly can also be used to engage the forward end of the upper member in the toe exposing position.

In operation, the user can place the pedicure boot 2 on the foot and employ the boot as any other type of shoe device. When a pedicure is to be applied, the user may remove the boot or may disengage the forward end 12 of the upper member 6 by releasing the female snap member 18 from the male snap member 16 to thereby disengage the forward end 12 of the upper member 6 from the forward end 15 of the sole member 4. The forward end 12 may be secured in the toe exposing position shown in FIG. 2*b* by a suitable means such as by engaging the female snap member 18 with the male snap member 20 appearing at the rearward portion 22 of the forward end 12.

When the pedicure is complete, the user may leave the pedicure salon with the toes exposed and the forward end 12 in the position shown in FIG. 2*a*. It will be noted, that unlike opened toe sandals, only the toe portion of the user's foot is exposed to the atmosphere. The remainder of the foot is completely covered by the pedicure boot thereby providing greater protection against cold and inclement weather particularly in the winter than provided by open toe sandal pedicure systems.

The pedicure boot of the present invention may be provided with a further attachment assembly enabling the foot to be more easily inserted into the boot. Referring again to FIGS. 1-3, the pedicure boot 2 has a rear portion 24 having an opening 25 for receiving the foot so that it can be placed in the foot receiving space 8 shown in FIG. 2*a*.

The rear portion may have a second attachment assembly 26 in which the rear portion may reversibly be disengaged into separated components to form a longitudinally disposed opening 28 (see FIG. 3) enabling the opening 25 to be expanded to facilitate entry of the foot into the boot. The second attachment assembly 26 can comprise any attachment device including those described for the first attachment assembly 14.

In the embodiment shown in FIGS. 1-3, the second attachment assembly 26 includes male snap members 32 and female snap members 34 shown best in FIG. 3 which may be adhered to an attachment assembly supporting substrate 36 such as a material suitable for attachment to the boot including leather, cloth, plastic and the like.

In operation, the second attachment assembly 26 may be disengaged by separating the male snap member 34 from the female snap members 32 to assume the position shown in FIG. 3 thereby facilitating entry of the foot into the boot.

It will be noted that the first attachment assembly 14 and the second attachment assembly 26 are separated from each other such that a portion of the upper member shown by the numeral 38 and the sole member shown by the numeral 40 remain permanently attached to each other. These permanent attached portions 38/40 appear on both sides of the boot (only one side is shown in FIG. 3). Thus, the first and second attachment assemblies 14/28 are separate from each other and their separate and distinct functions can be performed independently.

Figure 4:
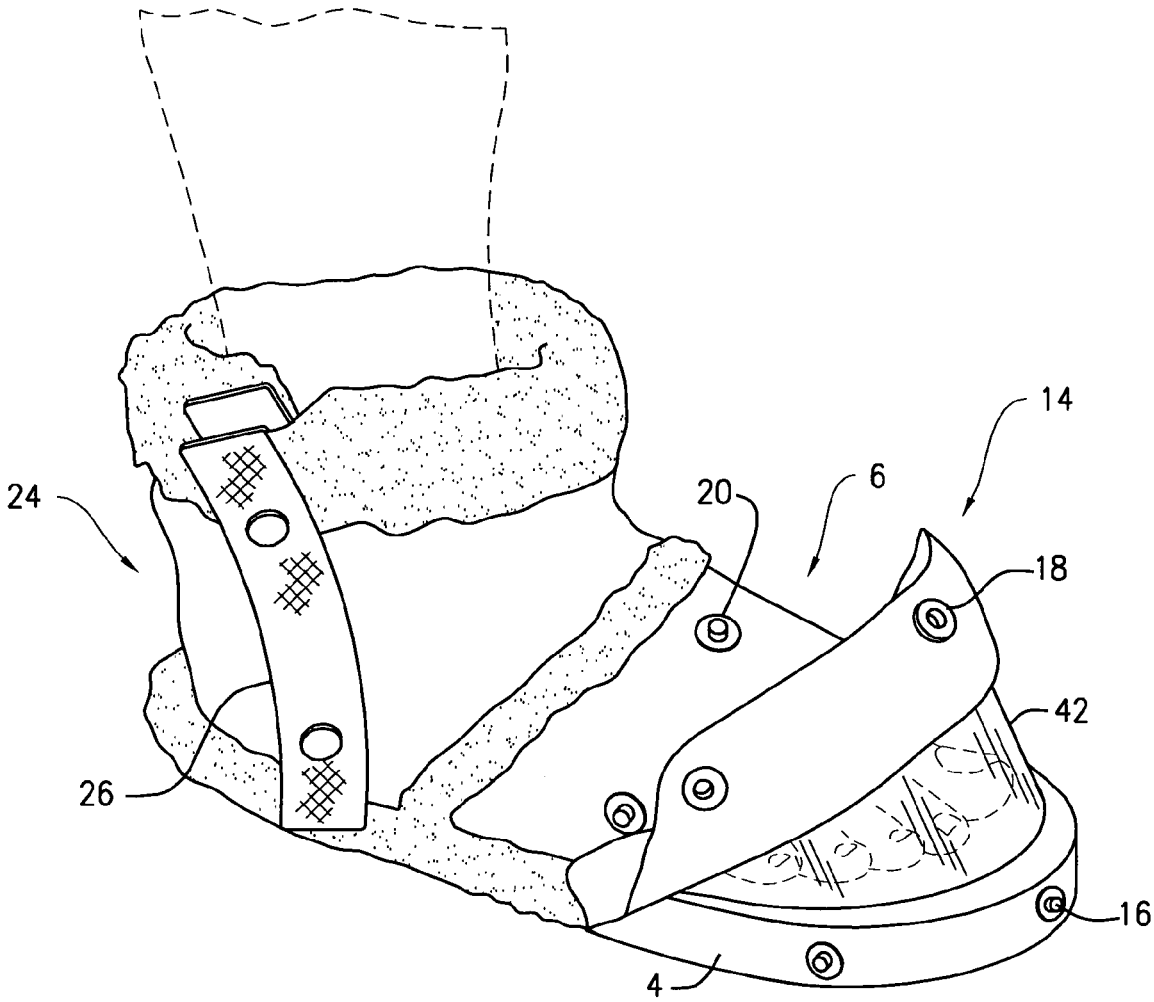
FIG. 4 is a perspective view of another embodiment of the pedicure boot in which a shield assists in preventing the front end of the upper member from touching the toes.

In a further embodiment of the invention, the forward end 12 of the upper member 6 may be assembled to provide greater clearance between the toes and the forward end 12 so that the toes may be completely covered even when the nail polish applied to the toes is still not completely dry. This embodiment is shown in FIG. 4 in which the forward portion of the boot is provided with a rigid member 42 which raises the elevation of the forward end to provide sufficient clearance above the toes.

The rigid member 42 may be attached to the under side of the forward end 12 of the upper member 6 or the forward end 15 of the sole member 4. The operation of the forward end 12 engaging the forward end 15 through the first attachment assembly 14 is conducted in the same manner as described above with sufficient clearance to cover the rigid member 42. Thus, the toes may be covered and exposed in the same manner as described in FIGS. 1-3.

As previously indicated the embodiments of the invention shown in FIGS. 1-3 provide separate attachment assemblies 14 and 26, respectively. These assemblies are separated by a permanent attachment obtained by the permanent attachment of a portion 38 of the upper member 6 and a corresponding portion 40 of the sole member 4 on each side of the boot. In a further embodiment of the invention, the permanent attachment portion on one side of the boot is eliminated so that the respective attachment assemblies can be opened and closed essentially together and their respective functions performed simultaneously.

Figure 5:
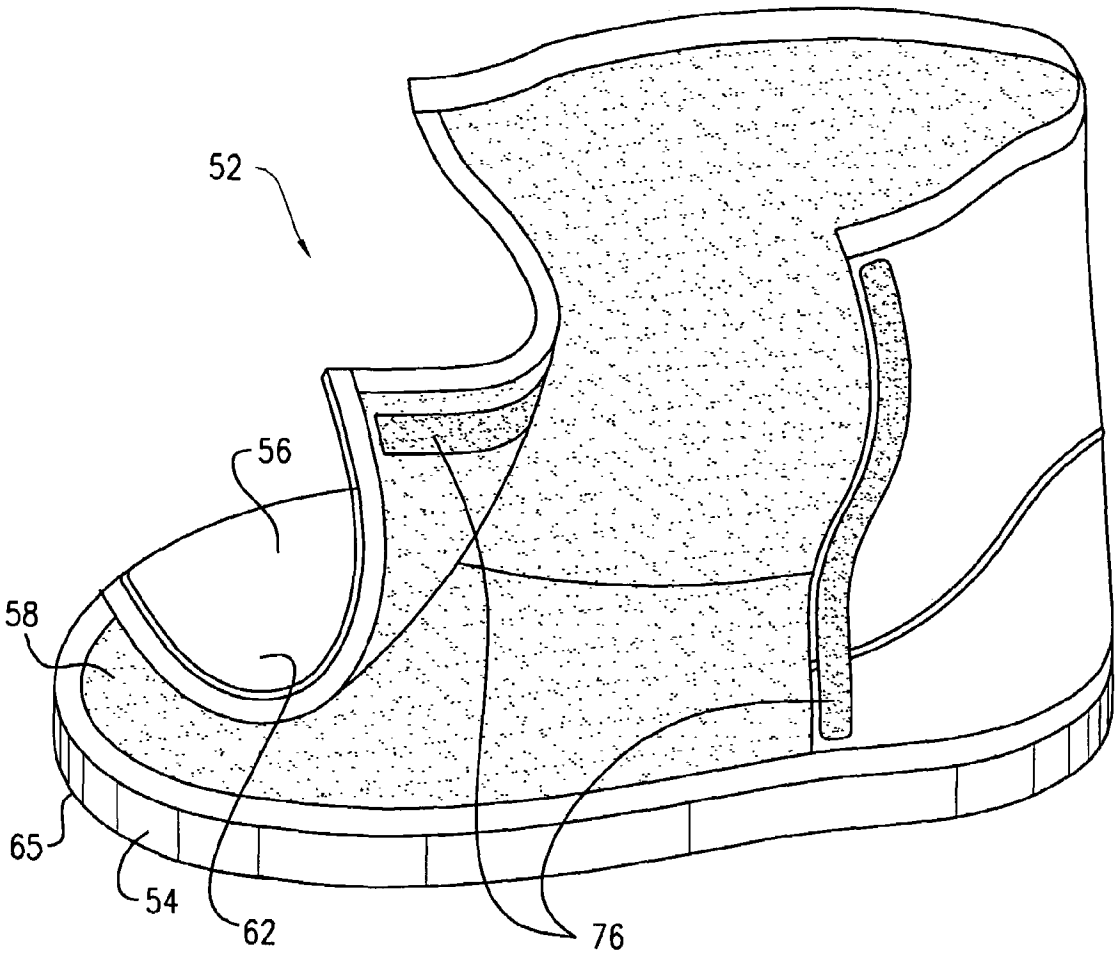
FIG. 5 is a side elevational view of a further embodiment of the pedicure boot in which the forward end and side portion of the upper member is disengaged from the front end and side portion of the sole member to free the toes and provide easy access into and out of the pedicure boot.
Figure 6:
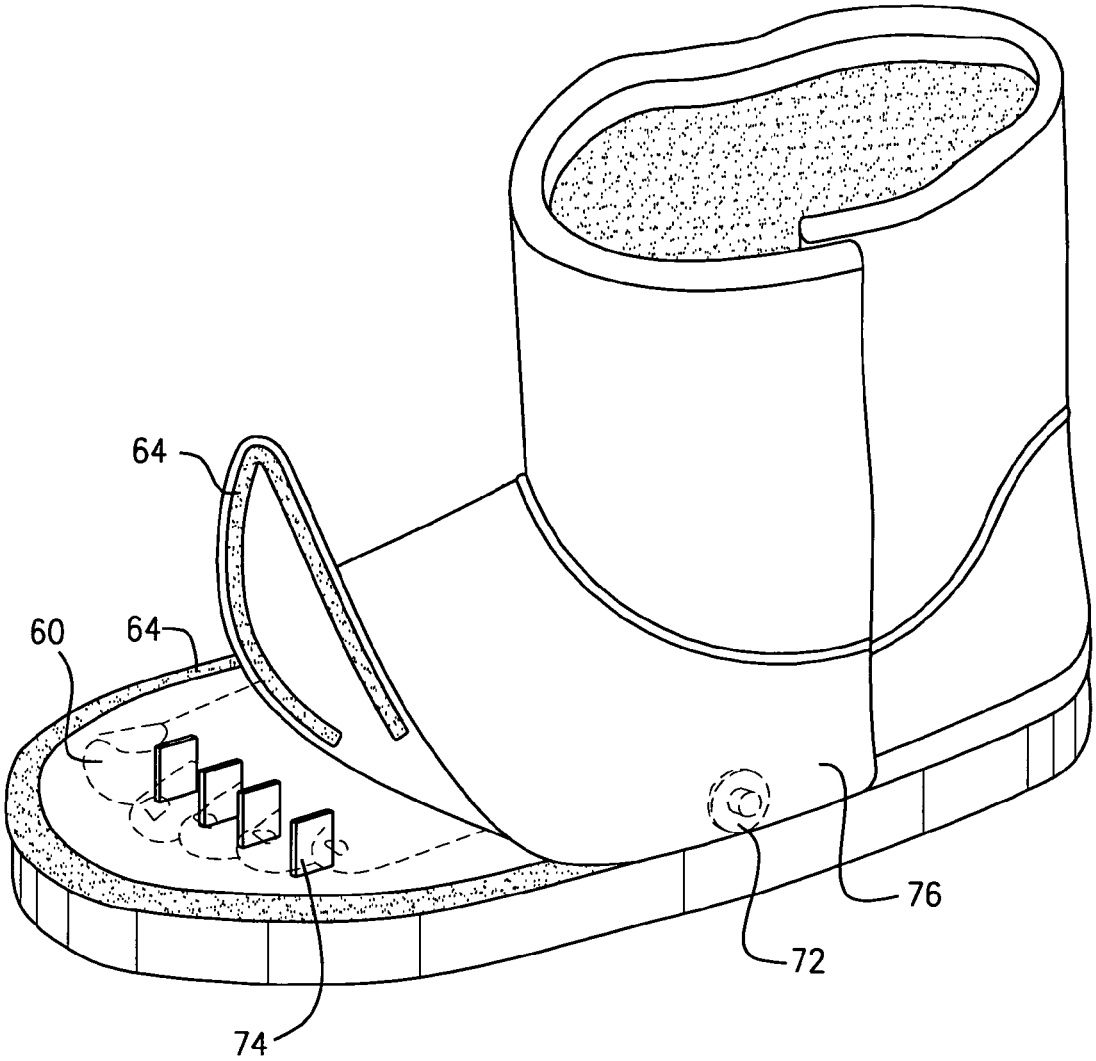
FIG. 6 is a side elevational view of a further embodiment of the pedicure boot of the present invention showing the toes separated by toe spacers.

Referring generally to FIGS. 5-8 and first to FIG. 5, there is shown a pedicure boot 52 of the present invention having a sole member 54 and an upper member 56 defining a foot receiving space 58 for receiving toes 60 (see FIG. 6). The boot has a forward end 62 for the upper member and a forward end 65 for the sole member which when engaged together provide a covering for the toes as previously described.

There is provided a first attachment assembly 64 (shown best in FIG. 6) for engaging the respective forward ends of the upper and sole members exemplified by the use of a hook and eye assembly and a second attachment assembly 76 similar to the attachment assembly 26 previously described for facilitating access of the foot into the boot. However, unlike the embodiments of FIGS. 1-3, there is no permanent attachment between the respective attachment assemblies 64 and 76 on one side of the pedicure boot. Thus, in a single continuous motion, the user can disengage the first attachment assembly 64 to uncover the toes and disengage the second attachment assembly 76 to facilitate entry of the foot into the boot.

In this embodiment it is possible to eliminate the attachment of the forward end 12 of the upper member 6 to the rearward portion 22 of the forward end 12 as previously described. It will be noted that the specific attachment device shown in FIG. 5 is a hook and eye attachment device such as Velcro®.

Figure 7:
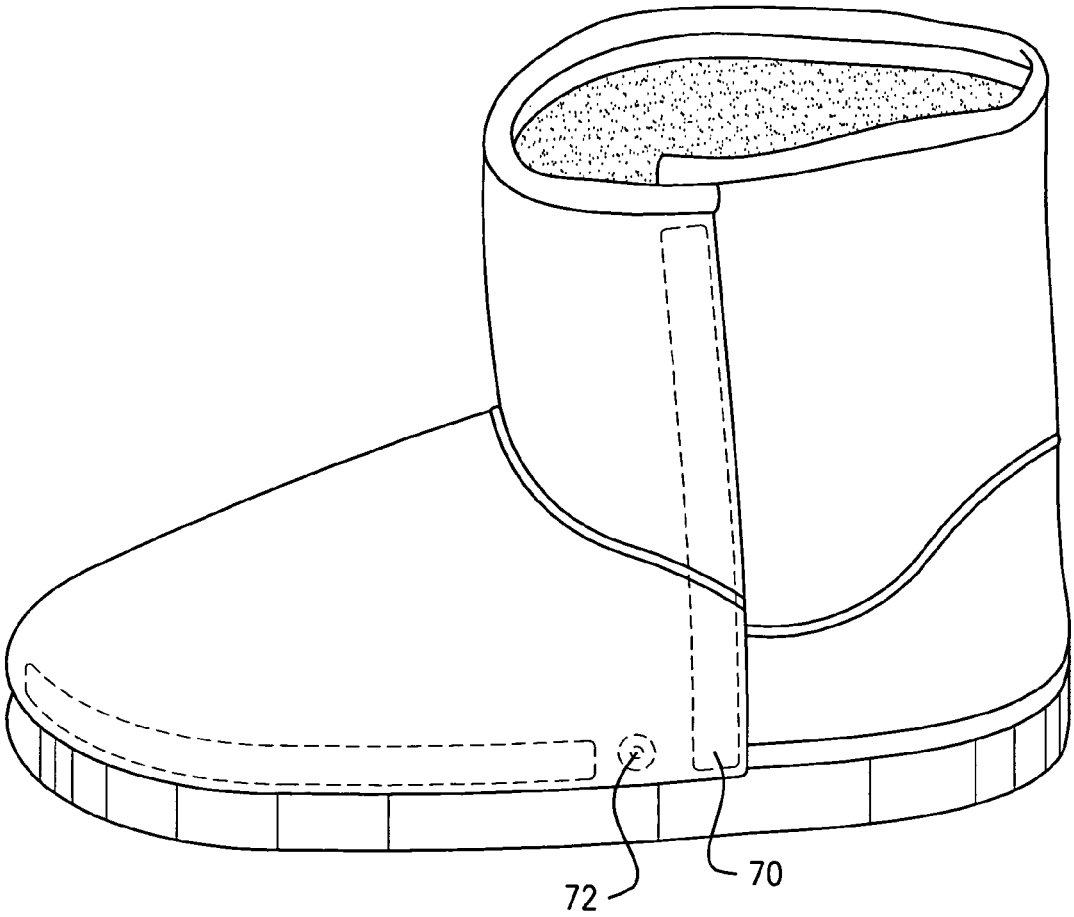
FIG. 7 is a side elevational view of an embodiment of the pedicure boot with the front end portion of the upper member in place covering the toes and the second portion of the upper member secured in place about the user's foot.

In the embodiment shown specifically in FIGS. 6 and 7, the first attachment assembly 64 is shown where the attachment device is a hook and eye assembly and the second attachment device employs the combination of a hook and eye assembly shown by the numeral 70 and a snap member assembly 72 comprised of male and female snap members as previously described.

In a still further embodiment of the invention, there is provided toe spacer's providing spaces between the toes that are particularly helpful in insuring that the toes do not come into contact with each other after completion of a pedicure treatment. The toe spacers can take a variety of forms including those shown in U.S. Pat. Nos. 5,946,823 and 6,678,971, incorporated herein by reference.

Figure 8:
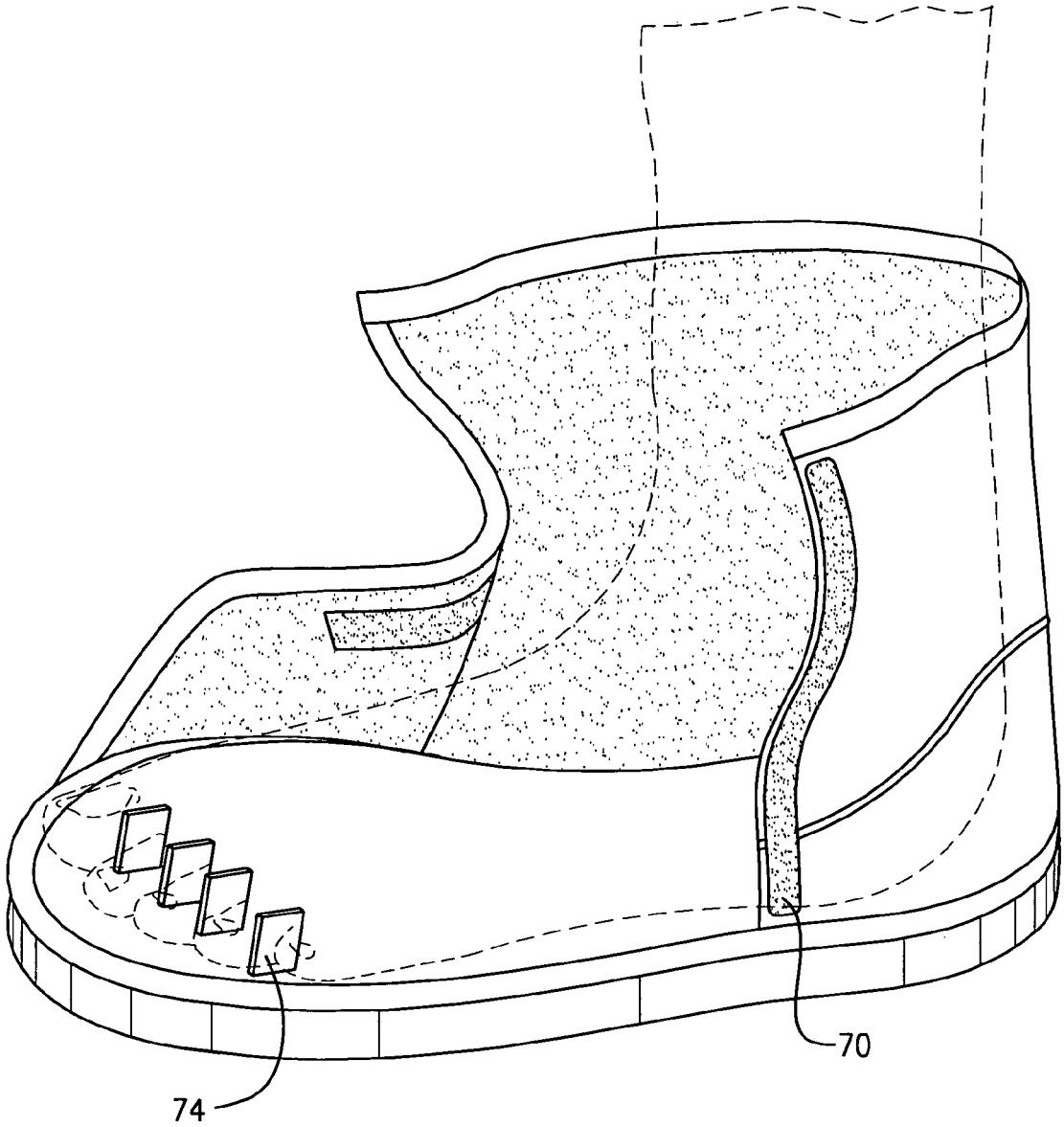
FIG. 8 is a side elevational view of the embodiment of FIG. 5 showing the user's foot within the pedicure boot and the toes spaced apart by toe spacers.

Referring to FIGS. 6 and 8, toes spacers 74 are spaced apart to provide spaces between the toes to insure that the toes are protected while drying from any accidental contact with each other. The toes spacers can be made from any suitable material such as plastic, metal and the like. The spacers may be in the form upstanding members as shown specifically in the drawing figures or may be comprised of raised portions of the sole member.

The foregoing embodiments of the invention are illustrative of aspects of the present invention and include modifications that would be considered routine by those of ordinary skill in the art. For example, the toe spacers can take on a variety of different types of toes spacers including raised projections that emanate from below the surface of the foot receiving surface of the sole member. In another routine embodiment, the materials for the pedicure boot can be chosen from leather, synthetic leather, vinyl, suede, cloth, synthetic and real fur, and the like.

What is claimed is:

1. A pedicure boot comprising:

a) a sole member having a forward end;

b) an upper member operatively engaged to the sole member to form a foot receiving space, said upper member having a forward end releasably engageable to the forward end of the sole member while a rearward portion of the upper member located behind the forward end remains engaged to the sole member, said forward end of the upper member being movable in the form of a flap by being folded over itself from a first position in engagement with the forward end of the sole member to a second position disengaged from the forward end of the sole member and operatively engaged to the rearward portion of the upper member to thereby expose a toe portion of a user's foot, said forward end further comprising a rigid member for raising the elevation of the forward end to provide clearance for the toes, said rigid member being attached to the under side of the forward end of the upper member and extending downwardly therefrom or being attached to the forward end of the sole member and extending upwardly therefrom; and c) a first attachment means for releasably engaging the forward end of the upper member to the forward end of the sole member in said first position.

2. The pedicure boot of claim 1 further comprising a engagement means for engaging the forward end of the upper member to the rearward portion of the upper member while the upper member is in the second position.

3. The pedicure boot of claim 2 wherein the engagement means comprises a first engaging device positioned on the forward end of the upper member and a second corresponding engaging device positioned rearwardly of the first engaging device wherein when the first and second engaging devices are engaged together, the forward end of the upper member is in said second position.

4. The pedicure boot of claim 1 further comprising a rear portion having an opening for receiving the foot of the user, said rear portion comprising a second attachment assembly for reversibly disengaging the rear portion into separate components to form a longitudinally disposed opening enabling the user to facilitate inserting the foot into the pedicure boot.

5. The pedicure boot of claim 4 wherein the upper member and the sole member are permanently attached to each other on at least one side of the pedicure boot between the rear portion and the forward ends of the upper member and sole member.

6. The pedicure boot of claim 4 wherein the upper member and the sole member are permanently attached to each other on both sides of the pedicure boot.

7. The pedicure boot of claim 1 further comprising toe spacers in the foot receiving space for separating the toes from each other.

* * * * *